United States Patent [19]

Jones

[11] Patent Number: 4,725,998

[45] Date of Patent: Feb. 16, 1988

[54] WARNING ASHTRAY

[75] Inventor: Brian D. Jones, 18400 Kross Rd., Riverside, Calif. 92502

[73] Assignee: David B. Jones, Brian D. Jones, Jr., and Karen N. Jones, Riverside, Calif.

[21] Appl. No.: 940,968

[22] Filed: Dec. 12, 1986

[51] Int. Cl.[4] ..... A24F 19/00; G04B 47/00

[52] U.S. Cl. ..... 368/10; 131/237; 131/238

[58] Field of Search ..... 368/9, 10, 107–113; 131/231–237; 340/568, 626, 665, 673, 309.15, 309.4

[56] References Cited

U.S. PATENT DOCUMENTS

| | | | |
|---|---|---|---|
| 2,588,537 | 3/1952 | Kelly | 131/237 |
| 2,752,877 | 7/1956 | Starkenberg | 116/101 |
| 3,095,108 | 6/1963 | McKenzie | 220/20.5 |
| 3,101,753 | 8/1963 | Taub | 141/248 |
| 3,205,900 | 9/1965 | Dahl | 131/238 |
| 3,360,790 | 12/1967 | Rossitto | 340/309.1 |
| 3,507,445 | 4/1970 | Breslow | 231/1 |
| 3,566,882 | 3/1971 | Schroeder | 131/234 |
| 4,094,326 | 6/1978 | Newman | 131/234 |
| 4,119,419 | 10/1978 | Passaro et al. | 55/212 |
| 4,428,386 | 1/1984 | Alloway | 131/231 |
| 4,520,345 | 5/1985 | Smit | 340/309 |
| 4,595,905 | 6/1986 | May | 340/309.15 |

*Primary Examiner*—Vit W. Miska

*Attorney, Agent, or Firm*—Knobbe, Martens, Olson & Bear

[57] ABSTRACT

A completely automatic warning ashtray for smokers is disclosed. The ashtray is responsive to the natural motions of a smoker, and indicates to the smoker when it is time to dispose of accumulated ash on a lit cigarette. Because of its automatic operation, the user need not operate any manual controls in order to accrue the advantages of the invention's use. In addition, the ashtray may be provided with a visual indicating means which indicates to the user that a timing cycle is in progress, and a time of day clock may also be visible from the outside of the ashtray.

19 Claims, 4 Drawing Figures

Fig. 1
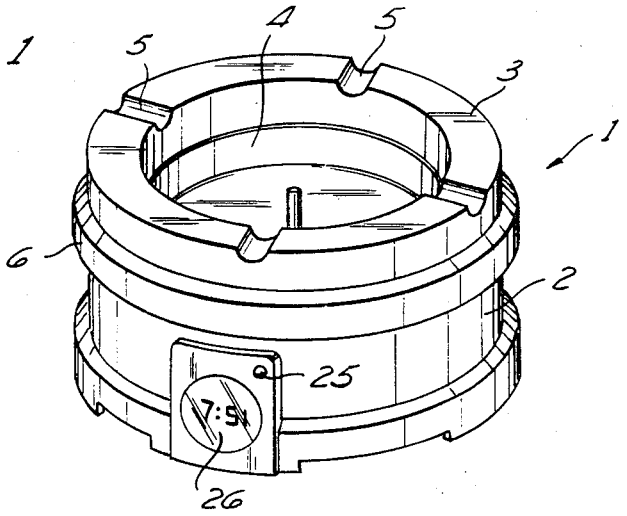
Fig. 2
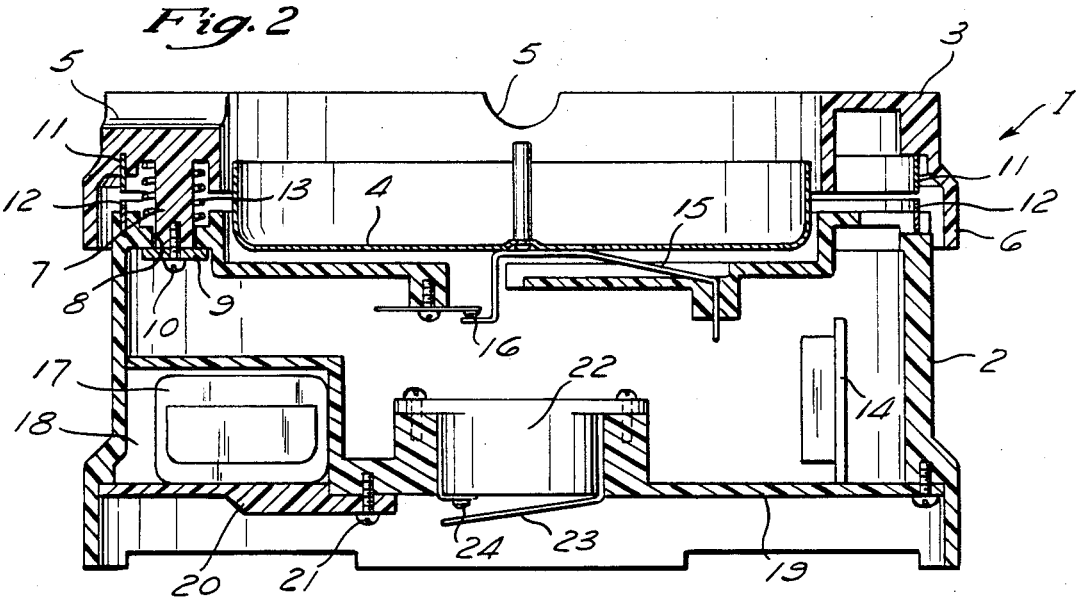
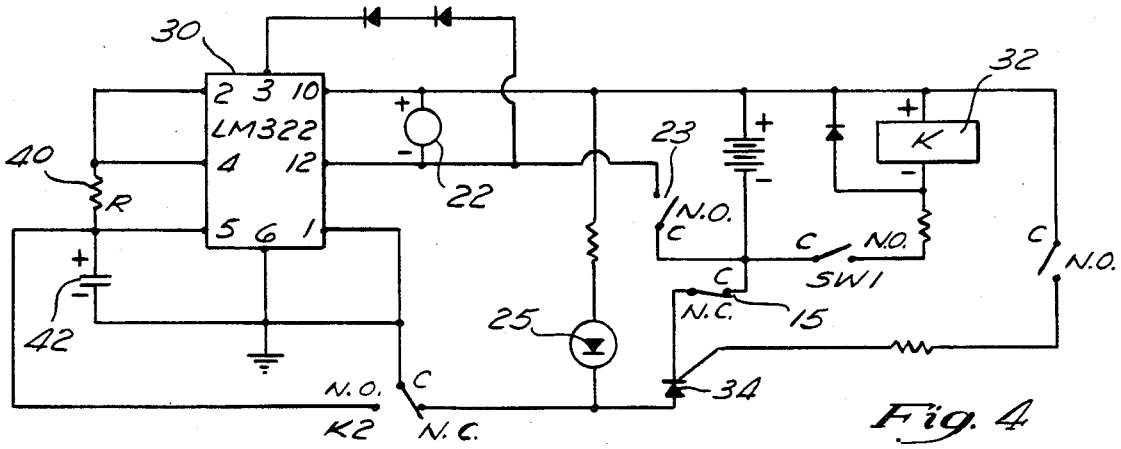
Fig. 4

WARNING ASHTRAY

BACKGROUND OF THE INVENTION

The present invention relates to a warning ashtray for smokers, more particularly, to a completely automatic warning ashtray which indicates to the user when it is time to dispose of accumulated ash on a lit cigarette. Because operation of the ashtray is keyed to the natural actions of the smoker, no controls need to be remembered nor extra motions be made in order to accrue the advantages derived from the invention's use. An ashtray of this nature is desirable because of its potential to prevent the occurrence of burns to furniture, desks, etc., resulting from temporarily forgotten or unattended cigarettes, and also from persons who may have fallen asleep with a lit cigarette. Use of the ashtray of the present invention may prevent a major fire from occurring.

A variety of warning systems associated with ashtrays are known. The prior art ashtrays generally have the disadvantage, however, that the user must remember to perform one or more steps in order to activate the alarm system. The inevitable result is non-use of the alarm system, thereby depriving the smoker of the ashtray's purported warning function. Moreover, the prior art safety ashtrays are generally directed to indicating a total burn time, disregarding the lesser interval at which ashes must be discarded, which can again result in the prior art device's failure to achieve its safety objective.

For example, U.S. Pat. No. 4,520,345 to Smit discloses an ashtray in which the manual opening of a normally closed lid activates an electronic timer which, at the end of a predetermined timing cycle, will trigger an alarm. If the lid is closed prior to the end of the cycle, the timer is deactivated. One of the problems with that ashtray, however, is that the user is required to work a manual control to open and close the lid for each cigarette. In addition, the timer system is designed to indicate total burn time, a period which can be undesirably long for a warning ashtray.

U.S. Pat. No. 4,428,386 to Alloway discloses what is called a safety ashtray in which the user must manually lift the entire ashtray, disposed on a vertically reciprocating push/pull switch, to close a circuit. In addition, the user must rotate a timer dial to a desired time interval. At the end of a time interval an alarm will sound unless the switch has been first opened by depressing the ashtray. This ashtray suffers from the same disadvantages of the prior art generally, in that the user must both remember and desire to work manual controls in order for the device to performs its intended function.

SUMMARY OF THE INVENTION

Accordingly, it is an object of the present invention to provide an improved warning ashtray which automatically responds to the natural motions of a cigarette smoker, to indicate the time at which it is necessary or desirable to dispose of accumulated ashes on a lit cigarette, whether held in the hand, or resting on some other support surface.

In accomplishing the foregoing object, there has been provided in accordance with one aspect of the present invention an automatic warning ashtray for smokers, comprising a timer, an actuating member disposed near the top of said ashtray, and an ash receiver. A means is provided which, in response to a downward pressure upon said actuating member, will commence a timing cycle to time a predetermined interval. Another means is provided which, in response to the end of said predetermined timing cycle, will activate a perceptible signal. A third means is provided for interrupting and restarting said timing cycle in response to pressure upon said actuating member. A fourth means is provided which, in response to a downward pressure upon said ash receiver, will deactivate the timing cycle and return the warning ashtray into the ready mode. The perceptible signal may be one that is either audible or visible, and in a preferred embodiment another visual signal may be provided which indicates that a timing cycle is in progress. In one preferred embodiment, the actuator member may comprise an annular actuating ring, and may further comprise a plurality of cigarette rests, oriented in an outward radial direction and disposed about the perimeter of said annular activating ring. The means responsive to downward pressure upon the rest for commencing a predetermined timing cycle may comprise an upper and a lower contact ring or a plurality of opposing contact pairs one or more of which is adapted to be brought into electrical contact with each other by the tapping or resting of a cigarette on the actuating ring. A further embodiment of the warning ashtray of the present invention may comprise a time of day clock. Further objects, features and advantages of the present invention will become apparent from the detailed description of preferred embodiments which follows, when considered together with the attached figures.

BRIEF DESCRIPTION OF THE DRAWINGS

FIG. 1 is a perspective view of a warning ashtray according to the present invention.

FIG. 2 is a partial sectional view of the warning ashtray of FIG. 1.

FIG. 4 is a circuit diagram of the warning ashtray according to the present invention.

DETAILED DESCRIPTION OF PREFERRED EMBODIMENTS

Figure 3:
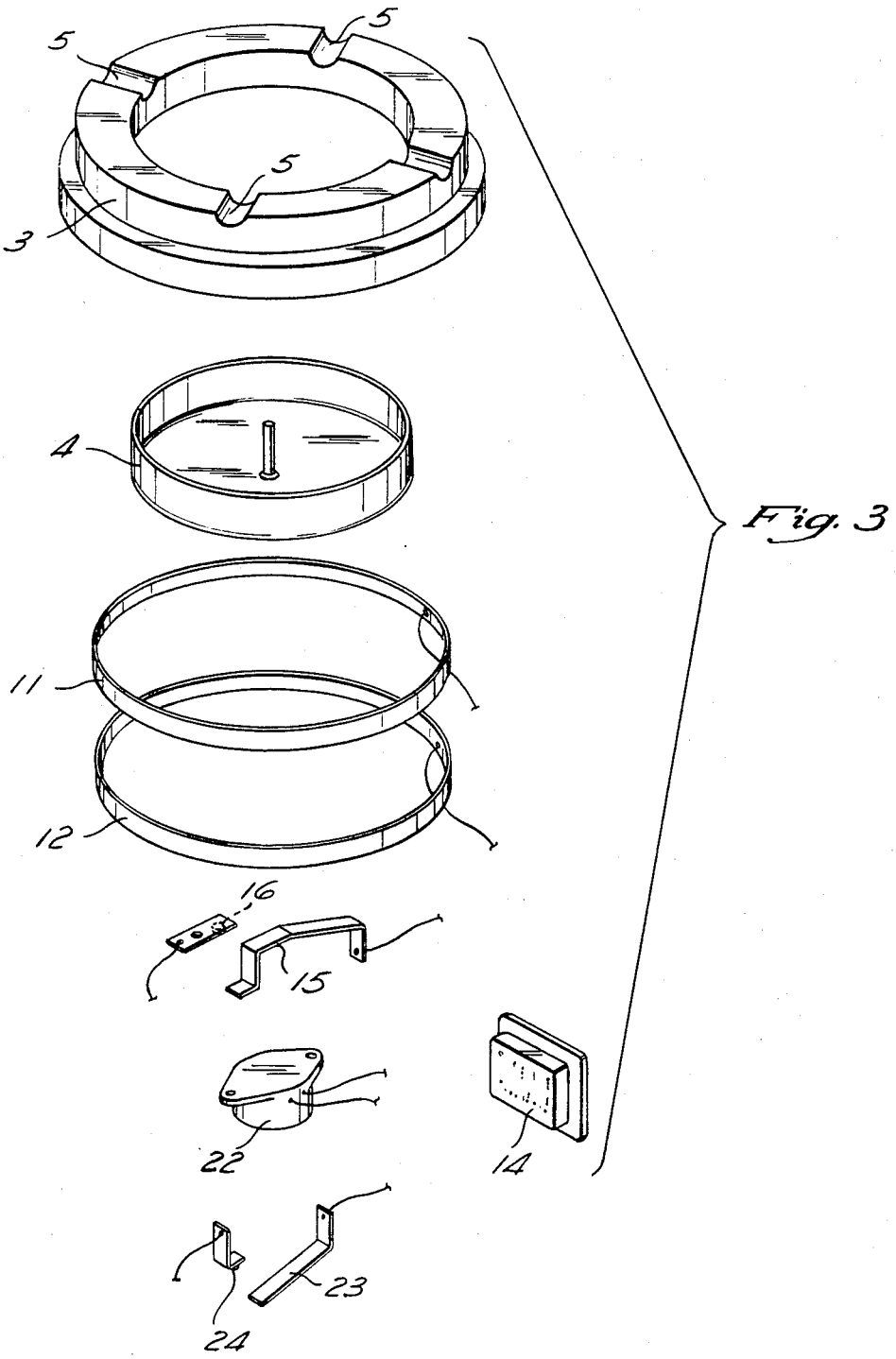
FIG. 3 is an exploded perspective view of a warning ashtray according to the present invention.

The ashtray of the present invention may be placed in a "ready" mode by connecting the appropriate power supply thereto. Preferably, a standard 9 volt transistor radio battery is used. In this mode, no current is drawn until the ashtray is activated by a smoker. (Although reference is made herein to cigarettes, it is understood that no limitation is intended thereby, and the invention contemplates use by other articles that may be smoked as well, such as a cigar or pipe.) Having lit a cigarette, the user may activate the warning circuits by either tapping the cigarette anywhere on the actuating member, including any of a plurality of cigarette rests disposed thereon or by placing the cigarette in one of the rests. Alternatively, the apparatus may be activated by tapping the actuating member or any of the cigarette rests with a finger.

Once activated in the foregoing manner, power is provided to a timer which will commence timing of a present interval which may be less than about 5 minutes, preferably is less than about 180 seconds, more preferably is between about 100 and 150 seconds, and most preferably is between about 120 and 140 seconds, during which time ash will accumulate on the burning cigarette in sufficient quantities to warrant disposal. According to one embodiment of the present invention, there is provided a light source which may be a light emitting diode or other indicator visible from the exterior of the body of the ashtray to indicate that the warning circuits are in an activated state, i.e., that the timer has commenced a timing cycle. Normally, the user will disposed of accumulated ash prior to the end of the timed interval by tapping the cigarette on one of the cigarette rests. This will automatically reset the warning circuit to provide another time interval of preferably between the about 100 and about 150 seconds. Thus, each time the smoker discards ashes in a usual way, the timer is reset to zero and continues to operate without interruption.

Should the user fail to reset the timer by either forgetting the cigarette or falling asleep, etc., at the end of the timed interval, the timer activates a warning buzzer or other signaling means which may be located in the main body of the ashtray, thereby alerting the user that something should be done with the cigarette. The signaling means may comprise, singly or in combination, audible tone generators, buzzers, a music source or programmed tone generator, or visual signaling means such as a light emitting diode or other light source.

If the user smokes the cigarette and disposes of it in the ashtray under normal conditions, the user will extinguish the butt of the cigarette by pressing it against the bottom of the removably mounted ashtray. This action of pressing the butt into the ashtray deactivates the warning circuits which are then returned to a "ready" position in which no power is being consumed and the timer circuit and alarm are deactivated. Thus, the ashtray is completely responsive to the natural motions of the smoker and no manual controls need be operated.

Preferably, the ashtray is provided with a test switch which may be located in any appropriate location, such as in the bottom cover of the body of the ashtray. When pressed, the test switch activates all of the electronic circuitry in a test mode. If the battery is sufficiently charged and the electronic components are all in order, the audible and/or the visual signaling means will be activated by this test.

Referring to FIG. 1, there is ilustrated a warning ashtray 1 according to one embodiment of the present invention. The ashtray is comprised of a main body 2 which comprises a substantially radially symmetrical member made of plastic or other synthetic material, or of a suitable metal, such as aluminum. Preferably the outer surfaces of the body will exhibit a "satin" or brushed finish, or some other non-glossy surface.

Disposed adjacent the top of the main body 2 is an actuating member 3 which, in this embodiment, takes the form of an annular ring. In the center thereof is disposed a removable ashtray or ash receiver 4, having a top and bottom portion. Rigidly affixed to the actuator member, or formed integrally therewith, are a plurality of cigarette rests 5, which in FIG. 1 take the form of a plurality of depressions in which a cigarette may be balanced.

The outer periphery of the actuating member 3 may be provided with an annular flange 6 which extends downward in an axial direction along the outer periphery of the main body 2. This is best illustrated in FIG. 2. The actuating member 3 may be connected to the main body 2 by means of a plurality of posts 7 moveably extendable through a corresponding plurality of openings 8 in the body 2. At the distal end of post 7, there may be provided a limiting means, for example, a setting washer 9 attached by means of a screw 10. The setting washer 9 has a diameter that is greater than the diameter of the opening 8, thereby functioning to limit the upward movement of the post 7 and of the entire actuating member 3 relative to the main body 2. A means is provided for biasing the actuating member 3 in an upward axial direction relative to the body 2, so that in its normal state the actuating member 3 is disposed at the upper end of the range of motion permitted by the limiting means 9. In this position, there exists a space between the electrical contacts 11 and 12, as set forth in more detail below. The tapping or resting of a cigarette on the actuating member 3 provides sufficient downward force to overcome the upward bias, thereby momentarily bringing the electrical contacts 11 and 12 into electrical connection, which will cause a timing cycle to begin. The biasing means may comprise any traditional means for exerting a force, such as spring metal, an elastomer or other resilient polymeric material, or mechanical counterbalancing. In FIG. 2 there is illustrated a conventional coil spring 13 that functions as the biasing means. The coil spring 13 is coaxially disposed about the post 7 and biased upwardly against the actuating member 3.

Rigidly mounted to the actuating member 3 is at least one electrical contact 11, which is responsive to downward pressure on the actuating member 3. The electrical contact 11 may take the form of an annular ring extending around the outer circumference of the ashtray 4, as illustrated in FIG. 3, or may take the form of a plurality of discrete contacts. Corresponding to each of the electrical contacts 11 in the actuating member 3 is an electrical contact 12 attached to the body 2. The contact 12 will take the form of either a plurality of contacts or an annular ring, corresponding to the configuration of the contact 11. The contacts 11, 12 are disposed in such a manner that they will come in contact with each other to form an electrical connection any time a cigarette is tapped upon the actuating member 3. Due to the upward bias exerted by spring 13, the contacts 11 and 12 are maintained in a spaced apart relationship until a force from the tapping of a cigarette on the actuating member 3 brings the contacts 11 and 12 into contact with each other.

The electrical contacts 11 and 12 are wired into a printed circuit board 14, disposed within the main body 2 (wiring not shown). The printed circuit board 14 comprises an electronic timer, and other electronic components necessary for the operation of the present invention. The elements making up the electronic circuitry involved in the present invention, e.g., electronic timing means, audio and/or visual signaling means, and switching circuits, are individually well known.

Also electrically connected to the printed circuit board 14 is a switch 15 which in FIG. 2, is disposed on the underside of the ashtray 4. Under normal conditions, the switch 15 is in contact with a contact 16 to form a normally-closed circuit. When downward pressure is exerted on the ashtray 4, for example, by the stubbing out of a cigarette, the switch 15 is momentarily deflected downwardly and out of contact with the contact 16 to open said circuit. The switch 15 is constructed in such a manner that when the pressure on the ashtray 4 is removed, the switch 15 will return to its original position in contact with the contact 16. As described more fully, supra, the momentary contacting of the electrical contacts 11 and 12 commences a timing cycle, and the momentary separation of the switch 15 from the contact 16 stops the timing cycle and rests the ashtray to a ready condition. Of course, any of a variety of conventional switching means may be used, which will respond to downward pressure on said tray, and the circuitry may be adapted for use of either normally open or normally closed switches.

Electrical power may be supplied by means of a battery 17 which in FIG. 2, is disposed within a battery compartment 18 formed in the main body 2. Preferably, the battery 17 is a 9-volt battery, and all of the other electronic components within the ashtray require 9 volts or less for operation. The battery compartment 18 is preferably recessed between the plane of a bottom panel 19 and the ashtray 4, and the battery 17 may be held in place by means of a battery retaining member 20 held in place by a screw 21 or other movable attachment means.

An audible signaling means 22 such as a buzzer is wired into the printed circuit board 14 and may be disposed between the ashtray 4 and the bottom panel 19. On the lower, outwardly exposed side of the bottom panel 19, there is provided, in a preferred embodiment, a test switch 23 for testing the electrical components in the warning ashtray. In the illustrated embodiment, the test switch 23 is disposed in a manner that pressure thereon will cause it to contact an electrical contact 24, which will momentarily activate the signaling means 22 and, in a preferred embodiment, a visual indicating means 25, if the battery and all other electrical components in the system are in working order. In normal operation, e.g., not test mode, the visual indicating means 25 may be used to indicate that a timing cycle has commenced and the ashtray has been activated. When the user has stubbed the cigarette out in the bottom of the ashtray, thereby deactivating the timer and returning the ashtray to a "ready" mode, the visual indicating means 25 may also be deactivated. The visual indicating means 25 may be a light emitting diode, or other suitable light source, or mechanical indicating means responsive to the operating modes of the ashtray.

In another embodiment of the present invention there is provided a time of day clock 26, preferably a clock having a liquid crystal display, which may be mounted on body 2.

Referring to FIG. 4, in the preferred embodiment, a timer integrated circuit 30 is wired to function as a oneshot, which emits a pulse after the predetermined time interval. A Natural Semiconductor LM322 precision timer or a 555 timer may be utilized, as well as other circuits commonly known to those skilled in the art. The pin numbering shown in FIG. 4 is for the LM322 integrated circuit. Selection of the resistance and capacitance values for resistor 40 (R) and capacitor 42 (C) determine the length of the timing interval (T) in accordance with the relationship $T=RC$.

Closing switch SW1 rests the timer 30 and opening SW1 commences the predetermined timing interval. Switch SW1 is closed to ground by tapping actuating member 3 of the ashtray thereby momentarily depressing contact rings 11, 12, energizing relay 32 and causing normally open relay contacts K1 and k2 of the double pole-double throw relay 32 to close. Closing contact K1 turns on siliconcontrolled rectifier (SCR) 34. Contact K2 also moves from the terminal marked "NC" (normally closed) to the terminal marked "NO" (normally open) shown in FIG. 4. When contact K2 is momentarily closed across "NO", the capacitor 42 is shorted, causing the capacitor to discharge and the timer 30 to be reset. Releasing the actuating member 3 opens SW1, de-energizes relay 32 and returns K2 to the "NC" position, thereby commencing the predetermined timing interval.

When the timer 30 starts the timing interval, and relay contact K2 is returned to the "NC" position (connected to ground), current flows through lightemitting diode 25 which provides an indicator light that the timer is armed and the timing interval has commenced. Absent further changes in the position of switches SW1 or 15 (by e.g., tapping the actuating member 3 or by stubbing out the cigarette), the timer will emit a pulse actuating the buzzer 22 after the predetermined time period has passed since timer 30 was reset by tapping actuating member 3.

Stubbing out the cigarette causes switch 15 (shown in FIG. 4) to be momentarily opened, thereby turning off SCR 34 which disarms timer 30. SCR 34 will not be turned on again until actuating member 3 is again depressed energizing relay 32 and closing contact K1 and contact K2 to the "NO" terminal.

Switch 23 is the buzzer test switch. When switch 23 is closed, the buzzer is grounded and, if functioning properly, will be activated.

Although this invention has been described in terms of certain preferred embodiments, other embodiments that are apparent to those of ordinary skill in the art are also within the scope of this invention. Accordingly, the scope of the invention is intended to be defined only by reference to the appended claims.

What I claim is:

1. An automatic warning ashtray for smokers, comprising:
   - a main body;
   - a timer disposed within said body;
   - an actuating member connected to said body;
   - means responsive to pressure upon said actuating member for causing said timer to commence a timing cycle to time a predetermined interval;
   - means responsive to pressure upon said actuating member for interrupting and restarting said timing cycle;
   - means responsive to the end of said timing cycle for activating a perceptible signal;
   - an ash receiver having a top and a bottom in said ashtray; and
   - means responsive to downward pressure upon said receiver for deactivating said timing cycle.

2. An automatic warning ashtray as in claim 1, wherein said perceptible signal comprises an audible signal.

3. An automatic warning ashtray as in claim 1, wherein said perceptible signal comprises a visual signal.

4. An automatic warning ashtray as in claim 1, further comprising a visual means for indicating that a timing cycle is in progress.

5. An automatic warning ashtray as in claim 4, wherein said visual indicating means comprises a light-emitting diode.

6. An automatic warning ashtray as in claim 1, wherein said ash receiver comprises a removably ashtray.

7. An automatic ashtray as in claim 1, wherein said actuating member comprises an annular ring disposed coaxially above said ash receiver.

8. An automatic warning ashtray as in claim 1, wherein said means for commencing a timing cycle comprises a pair of annular contact rings which are brought into electrical contact with each other in response to a force exerted upon said actuating member.

9. An automatic warning ashtray as in claim 1, wherein said means for commencing a timing cycle comprises a air of spaced apart electrical contacts which are brought into electrical contact with each other in response to a force exerted upon said actuating member.

10. An automatic warning ashtray as in claim 1, wherein the duration of said timing cycle is less than about 120 seconds.

11. An automatic warning ashtray as in claim 10, wherein the duration of said timing cycle is from about 50 to about 80 seconds.

12. An automatic warning ashtray as in claim 1, further comprising a time of day clock.

13. An automatic warning ashtray for smokers, comprising:

a body, an actuating member mounted on said body, an ash receiver disposed within said body, a timer, electrically connected to said actuating member, and an alarm, electrically connected to said timer;

means for automatically activating said timer in response to pressure upon said actuating member and means for automatically deactivating said timer in response to pressure on said ash receiver.

14. An automatic warning ashtray as in claim 13 wherein said alarm is activated in response to the end of a predetermined timing cycle, and wherein the timing cycle is initiated in response to pressure on said actuating member.

15. An automatic warning ashtray as in claim 14, wherein said timing cycle is reset and re-initiated in response to pressure upon said actuating member.

16. An automatic warning ashtray as in claim 13, wherein said actuating member comprises a plurality of cigarette rests.

17. An automatic warning ashtray as in claim 13, further comprising a visual indicator means for indicating that the timer is in an activated state.

18. An automatic warning ashtray as in claim 13, wherein said alarm produces an audible signal.

19. An automatic warning ashtray, comprising:

a substantially radially symmetrical body having an annular actuator ring disposed thereon, wherein said actuator ring comprises a plurality of cigarette rests;

a removable, substantially radially symmetrical ash receiving tray disposed coaxially within said body;

a timer and an alarm disposed within said body and electrically connected to said actuator ring and to said ash receiving tray, wherein said timer is activated in response to a pressure upon said actuator ring to commence timing of a predetermined interval, wherein said timer is deactivated in response to pressure upon said ash receiving tray, and wherein said alarm is activated in response to the end of said predetermined interval.

* * * * *